US012781625B2

(12) United States Patent
Bataweel et al.

(10) Patent No.: US 12,781,625 B2
(45) Date of Patent: Nov. 3, 2026

(54) IN-SITU SWEEP TESTING SYSTEM AND METHOD FOR CONDUCTING IN-SITU OIL RECOVERY SWEEP TESTING

(71) Applicant: SAUDI ARABIAN OIL COMPANY, Dhahran (SA)

(72) Inventors: Mohammed Bataweel, Dhahran (SA); Eyad Ali Alali, Dammam (SA); Bander I. Quaimi, Al Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/179,329

(22) Filed: Apr. 15, 2025

(65) Prior Publication Data

US 2026/0160162 A1 Jun. 11, 2026

Related U.S. Application Data

(63) Continuation of application No. 18/064,030, filed on Dec. 9, 2022, now abandoned.

(51) Int. Cl.
*E21B 49/00* (2006.01)
*E21B 47/06* (2012.01)

(52) U.S. Cl.
CPC ..... *E21B 49/008* (2013.01); *E21B 47/06* (2013.01)

(58) Field of Classification Search
CPC ..... E21B 49/008; E21B 47/06
See application file for complete search history.

(56) References Cited

U.S. PATENT DOCUMENTS

| | | | | |
|---|---|---|---|---|
| 7,784,539 | B2 * | 8/2010 | Montaron | E21B 43/16 166/50 |
| 2004/0069487 | A1 * | 4/2004 | Cook | E21B 47/00 166/313 |
| 2006/0086501 | A1 * | 4/2006 | Creel | E21B 43/261 166/295 |
| 2015/0204170 | A1 * | 7/2015 | Ayan | E21B 43/164 166/250.01 |

* cited by examiner

*Primary Examiner* — D. Andrews
(74) *Attorney, Agent, or Firm* — Osha Bergman Watanabe & Burton LLP

(57) ABSTRACT

A testing system includes a main wellbore, at least one injection tunnel and production tunnel, a monitoring system including at least one sensor, and a recovering tube. The injection and production tunnels are parallel with each other and extend perpendicularly from the main wellbore. The method for conducting in-situ oil recovery sweep testing includes introducing an injection fluid into a main wellbore and at least one injection tunnel, monitoring conditions of the at least one production tunnel, and collecting produced fluid from the production tunnel with a recovering tube. A method for conducting sequential in-situ oil recovery sweep testing includes locating a recovering tube in a target production tunnel and conducting a sweeping process. The sweeping process includes introducing an injection fluid into an injection tunnel, monitoring conditions of the target production tunnel, collecting a produced fluid from the target production tunnel, isolating the target production tunnel, and repeating.

12 Claims, 5 Drawing Sheets

IN-SITU SWEEP TESTING SYSTEM AND METHOD FOR CONDUCTING IN-SITU OIL RECOVERY SWEEP TESTING

BACKGROUND

Secondary and tertiary oil recovery (i.e., enhanced oil recovery or EOR) operations in oil and gas extraction are generally conducted after a primary oil recovery operation. In the secondary and tertiary oil recovery operation, an injection fluid, such as water or gas and may include other chemicals, is injected into a subterranean well ("injection well") to further extract hydrocarbons from the subterranean formation by displacing the hydrocarbons with the injected fluid. Secondary and tertiary oil recovery is often a costly operation, as proper planning of resources and establishment of facilities are required to effectively execute the operation.

Accurate assessment of the effectiveness of oil displacement by the injection fluid or displacing fluid in the subterranean formation, and the ability of the subterranean formation to receive the injection/displacing fluid ("injectivity") is generally desired or required in order to determine proper recovery methods of the secondary and tertiary oil recovery operation.

In order to assess the effectiveness of oil displacement, and validate the interaction between the fluid and the subterranean formation, core-flooding technique may be used in which the representative injection fluid is injected into a "core sample" or a sample of the subterranean formation to obtain parameters such as permeability, and saturation change. Alternatively, a single well field trial may be conducted in which a single well is used as simulated injection and production well to obtain the interaction behavior of the fluid and subterranean formation. However, neither method is considered as an in-situ representation of the injection and production well setting of the secondary and tertiary oil recovery operation and therefore, such methods may provide inaccurate information regarding the injectivity. Inaccurate injectivity information may lead to improper planning and setup of the secondary and tertiary oil recovery operation, and as a result, may cause a negative financial impact on the oil recovery operation. Accordingly, there exists a need an in-situ testing method to assess the effectiveness of oil displacement and injectivity by the injection fluid.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to an in-situ sweep testing system. The testing system comprises a main wellbore, at least one injection tunnel extending from the main wellbore in a perpendicular direction to a length direction of the main wellbore, at least one production tunnel extending from the main wellbore in the perpendicular direction to the length direction of the main wellbore and parallel to the at least one injection tunnel, a monitoring system comprising at least one sensor located in, or at an opening of, the at least one production tunnel, the monitoring system configured to monitor conditions of the at least one production tunnel, and a recovering tube at least partially located in, or at an opening of, the at least one production tunnel.

In another aspect, embodiments disclosed herein relate to a method for conducting in-situ oil recovery sweep testing. The method comprises introducing an injection fluid into a main wellbore and at least one injection tunnel, monitoring conditions of the at least one production tunnel with a monitoring system, and collecting the produced fluid from the at least one production tunnel with a recovering tube. The injection tunnel extends from the main wellbore in a perpendicular direction to a length direction of the main wellbore to extract a produced fluid in at least one production tunnel. The production tunnel extends from the main wellbore in the perpendicular direction to the length direction of the main wellbore and parallel to the at least one injection tunnel. The monitoring system comprises at least one sensor located in, or at an opening of, the at least one production tunnel. The recovering tube is located at least partially in, or at the opening of, the at least one production tunnel.

In another aspect, embodiments disclosed herein relate to a method for conducting sequential in-situ oil recovery sweep testing. The method comprises locating a recovering tube at least partially in, or at an opening of, a target production tunnel of at least two production tunnels, and conducting a sweeping process. The sweeping process comprises introducing an injection fluid into the main wellbore and the at least one injection tunnel to extract a produced fluid in the target production tunnel, monitoring conditions of the target production tunnel with a monitoring system, collecting the produced fluid from the target production tunnel with the recovering tube, and isolating the target production tunnel to be an isolated production tunnel. The method further comprises repeating the locating the recovering tube and the conducting the sweeping process. The production tunnel extends from a main wellbore in a perpendicular direction to a length direction of the main wellbore and parallel to at least one injection tunnel extending from the main wellbore in the perpendicular direction to the length direction of the main wellbore. The monitoring system comprises at least one sensor located in, or at an opening of, the target production tunnel. The recovering tube is located at least partially in, or at the opening of, the target production tunnel.

Other aspects and advantages of the claimed subject matter will be apparent from the following description and the appended claims.

DETAILED DESCRIPTION

In one aspect, embodiments disclosed herein relate to an in-situ sweep testing system. The system may include a main wellbore, at least one injection tunnel extending from the main wellbore in a perpendicular direction to a length direction of the main wellbore, and at least one production tunnel extending from the main wellbore in a perpendicular direction to a length direction of the main wellbore, and parallel to the at least one injection tunnel. The system may also include a monitoring system comprising at least one sensor located in, or at the opening of, the at least one production tunnel, and a recovering tube. The monitoring system may be configured to monitor conditions of the at least one production tunnel, and the recovering tube may be configured to collect a produced fluid from the at least one production tunnel.

In-Situ Sweep Testing System

Figure 1:
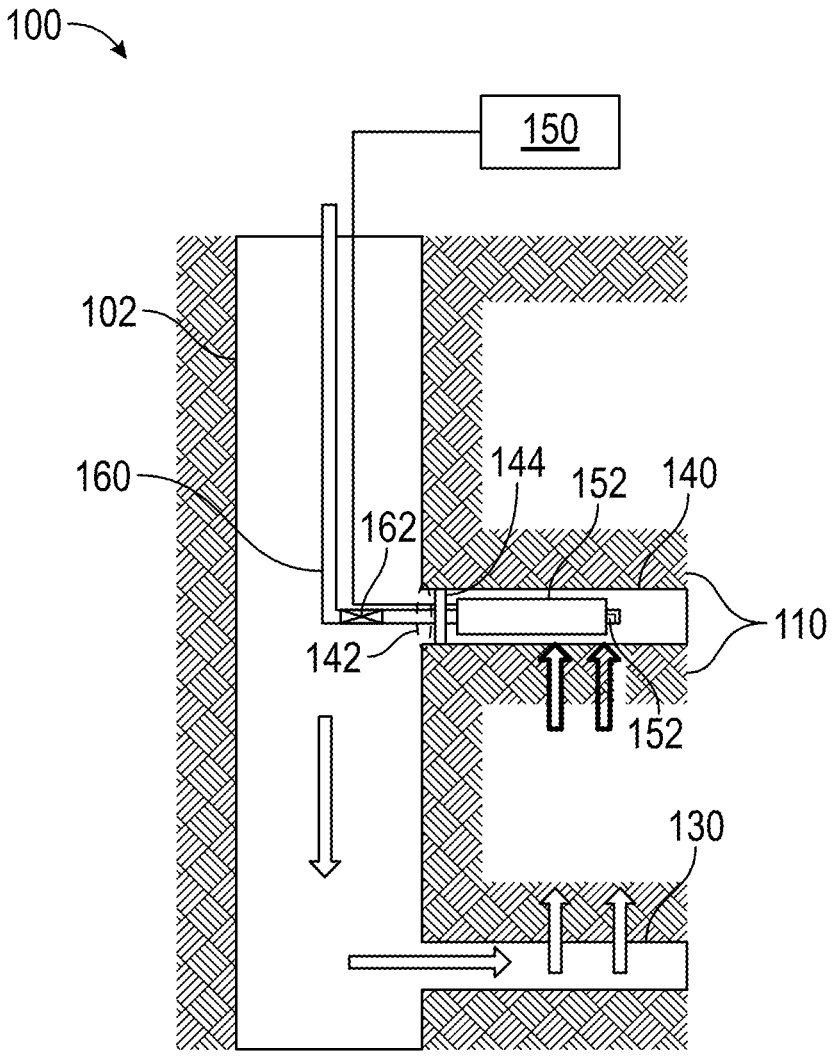
FIG. 1 is a schematic diagram illustrating an in-situ sweep testing system with a vertical main wellbore according to one or more embodiments.

FIG. 1 is an exemplary schematic diagram illustrating an in-situ sweep testing system 100 with a vertical main wellbore according to one or more embodiments. In the present disclosure, "oil recovery sweep testing" or a "sweep test" refers to a test conducted by using the injection and production tunnels, which simulates the sweeping or extraction of hydrocarbons from the reservoir in the secondary and tertiary oil recovery process. As a result, accurate information and data may be obtained by the sweep test to establish and execute secondary and tertiary recovery processes.

The in-situ sweep testing system ("testing system") 100 includes a main wellbore 102, at least one injection tunnel 130 and at least one production tunnel 140 that extend from the main wellbore 102 in a perpendicular direction to a length direction of the main wellbore 102. In the present disclosure, a "main wellbore" refers to a subterranean wellbore which is drilled to be used for oil and gas extraction operations. The main wellbore 102 may include a wellbore used for primary hydrocarbon recovery, and also injection and production wellbores used for secondary and tertiary hydrocarbon recovery processes. A length direction of the main wellbore refers to a direction parallel to the longest dimension of the main wellbore 102.

In the present disclosure, a "tunnel," which includes an injection tunnel and a production tunnel, refers to a hole that extends from the main wellbore to be used to conduct the in-situ sweep test. The dimensions of the tunnel may be substantially different from the dimensions of the main wellbore.

The testing system 100 includes a monitoring system 150 comprising at least one sensor 152 located in the production tunnel 140. While the sensor 152 is located in the production tunnel 140 in FIG. 1, it may alternatively be located at the opening 142 of the production tunnel 140. The testing system 100 also includes a recovering tube 160 that is at least partially located in the production tunnel 140 as shown in FIG. 1. Alternatively, the recovering tube 160 may be located at the opening 142 of the production tunnel 140. A recovering tube refers to any tube-shaped material which may be introduced through the main wellbore 102 to collect the extracted produced fluid in order to calculate the estimated oil recovery ("recovery calculations") and conduct analyses, such as determination of the produced fluid constituents, as necessary. In the present disclosure, a "produced fluid" refers a fluid extracted from a subterranean formation. The produced fluid may be extracted by injecting an injection fluid into the injection tunnel. The at least one sensor 152 may be connected to the recovering tube 160 or located in the recovering tube 160. The production tunnel 140 has a seal 144 at the opening 142 or near the opening 142 of the production tunnel 140 in order to prevent the produced fluid from flowing into the main wellbore 102 and recirculating back to the injection tunnel 130, and allow the produced fluid to flow into the recovering tube 160. The seal 144 can be a temporary seal or a permanent seal. Near the opening 142 refers to as an area inside of the production tunnel 140 that is located within about 50 feet from the opening 142 of the production tunnel 140, such as within 50, 40, 30, 20, 10, 5, 4, 3, 2, or 1 feet from the opening 142 of the production tunnel 140.

An injection fluid is introduced into the main wellbore 102 and then into the injection tunnel 130. The injection fluid then enters the subterranean formation 110. The injection fluid displaces the fluid in the subterranean formation 110, and the fluid in the subterranean formation 110 is extracted via the production tunnel 140 as a produced fluid. The produced fluid may contain water, hydrocarbons, and various inorganic and organic compounds. The inorganic and organic compounds may include salt, sand/mud, metals and chemicals which may be naturally present in the subterranean formation or which may be foreign substances introduced into the formation, such as chemical components included in the injection fluid. The conditions in the production tunnel 140 may be monitored by the monitoring system 150, and the produced fluid may be collected via the recovering tube 160 for recovery calculations and analyses.

In one or more embodiments, the testing system 100 includes at least one injection tunnel 130 and at least one production tunnel 140 which extend from a main wellbore in a perpendicular direction to a length direction of the main wellbore. There may be one injection tunnel 130 and one production tunnel 140 as shown in FIG. 1, or a plurality of injection tunnels and production tunnels. In one or more embodiments, the at least one production tunnel 140 is at least two production tunnels. The number of required injection tunnels and production tunnels may be determined based on factors such as stimulation requirement for the recovery operation, geology of the reservoir, and design parameters.

In the present disclosure, a "perpendicular direction" to a length direction of the main wellbore 102 refers to a direction that is "exactly perpendicular" or "about perpendicular" to a length direction of the main wellbore 102. Exactly perpendicular refers to an angle of 90° to the length direction of the main wellbore 102. "About" perpendicular refers to an angle in a range from about 80° to about 100°, such as a lower limit selected from any one of 80, 85, 86, 87, 88, 89, 89.5 and 89.9° to an upper limit selected from any one of 90.1, 90.5, 91, 92, 93, 94, 95 and 100°, where any lower limit may be paired with any upper limit.

In one or more embodiments, the main wellbore 102 has a diameter in a range from about 3 inches to about 9 inches, such as a lower limit selected from any one of 3.0, 3.5, 4.0, 4.5, 5.0, 5.5, 6, and 6.125 inches, to an upper limit selected from any one of 8.5, 8.625, 8.75, 8.875 and 9 inches, where any lower limit may be paired with any upper limit.

The main wellbore 102 may be a vertical wellbore, a horizontal wellbore, an angled wellbore, or a combination thereof.

In one or more embodiments, the injection tunnel 130 has a diameter of about 7.0 inches or less, such as 7.0 inches or less, 6.5 inches or less, 6.0 inches or less, 5.5 inches or less, 5.0 inches or less, 4.5 inches or less, 4.0 inches or less, 3.5 inches or less, 3.0 inches or less, 2.5 inches of less, or 2.0 inches or less. In one or more embodiments, the injection tunnel 130 has a dimeter in a range from about 0.125 to about 7.0 inches, such as a lower limit selected from any one of 0.125, 0.25, 0.375 and 0.5 inches to an upper limit selected from any one of 2.0, 2.5, 3.0, 3.5, 4.0, 4.5, 5.0, 5.5, 6.0, 6.5 and 7.0 inches, where any lower limit may be paired with any upper limit.

In one or more embodiments, the production tunnel 140 has a diameter of about 7.0 inches or less, such as 7.0 inches or less, 6.5 inches or less, 6.0 inches or less, 5.5 inches or less, 5.0 inches or less, 4.5 inches or less, 4.0 inches or less, 3.5 inches or less, 3.0 inches or less, 2.5 inches or less, or 2.0 inches or less. In one or more embodiments, the production tunnel 140 has a dimeter in a range from about 0.125 to about 7.0 inches, such as a lower limit selected from any one of 0.125, 0.25, 0.375 and 0.5 inches to an upper limit selected from any one of 2.0, 2.5, 3.0, 3.5, 4.0, 4.5, 5.0, 5.5, 6.0, 6.5 and 7.0 inches, where any lower limit may be paired with any upper limit.

In one or more embodiments, the injection tunnel 130 has a length of 300 feet or less, such as 300 feet or less, 250 feet or less, 225 feet or less, and 200 feet or less. In one or more embodiments, the injection tunnel 130 has a length in a range from about 5 feet to about 300 feet, such as a lower limit selected from any one of 5, 10, 20, 30, 40, and 50 feet, to an upper limit selected from any one of 200, 225, 250, 275 and 300 feet, where any lower limit may be paired with any upper limit.

In one or more embodiments, the production tunnel 140 has a length of 300 feet or less, such as 300 feet or less, 250 feet or less, 225 feet or less, and 200 feet or less. In one or more embodiments, the production tunnel 140 has a length in a range from about 5 feet to about 300 feet, such as a lower limit selected from any one of 5, 10, 20, 30, 40, and 50 feet, to an upper limit selected from any one of 200, 225, 250, 275 and 300 feet, where any lower limit may be paired with any upper limit.

In one or more embodiments, the injection tunnel 130 and the production tunnel 140 are parallel to each other. The injection tunnel 130 and the production tunnel 140 that are "parallel to each other" refers to the injection and production tunnels that extend from the main well such that the difference in the angles of lines parallel to the length direction of the injection and the production tunnel is less than about 5°, such as less than 5, less than 4, less than 3, less than 2, less than 1, less than 0.5, or less than 0.1°. In one or more embodiments, the injection tunnel 130 and the production tunnel 140 are exactly parallel to each other, or the difference in the angles of the lines parallel the length direction of the injection and the production tunnel is 0°.

In or more embodiments, the injection tunnel 130 and production tunnel 140 may be drilled using suitable drilling techniques and equipment known in the art. In one or more embodiments, the injection and production tunnels may be drilled with a mechanical radial drilling technique in order to have a controlled placement of the tunnel and penetration.

In one or more embodiments, the testing system 100 includes a monitoring system 150 comprising at least one sensor 152 located in, or at the opening 142 of, the production tunnel 140, and configured to monitor conditions of the production tunnel 140. The monitored conditions may include pressure and temperature of the tunnel, and flow rate of the produced fluid in the production tunnel 140. The monitoring system 150 may be any monitoring equipment suitable for measuring the bottom hole condition of a subterranean well. In one or more embodiments, the monitoring system 150 includes a modified production logging tools (PLT) testing device designed for monitoring of a main wellbore, and is capable of obtaining and evaluating downhole zonal flow parameters.

In one or more embodiments, the monitoring system 150 includes at least one sensor 152 to measure various conditions of the production tunnel 140, such as pressure, and temperature, and the flowrate of the produced fluid in the production tunnel 140 extracted from the subterranean formation by injecting an injection fluid into the injection tunnel 130. In one or more embodiments, a plurality of sensors 152 is located in, or at the opening 142 of, the production tunnel 140. In one or more embodiments, one sensor 152 is located in, or at the opening 142 of, the production tunnel 140. The sensors 152 may be located in the production tunnel 140 permanently or may be located temporarily.

In one or more embodiments, the monitoring system 150 includes a processor to analyze the information and data collected by the sensor 152, and a display device, such as a monitor. The processor and the display device may be located outside of the wellbore above the surface, and the sensor 152 may be connected to the processor with a cable for communication, or the sensor may communicate with the processor wirelessly.

In one or more embodiments, the testing system 100 includes a recovering tube 160 at least partially located in, or at an opening 142 of, the at least one production tunnel 140 and configured to collect a produced fluid from the at least one production tunnel 140. As noted previously, the production tunnel 140 has a seal 144 to prevent the produced fluid from flowing into the main wellbore 102 and the injection tunnel 130 and to allow the produced fluid to be collected by the recovering tube 160. In embodiments in which the recovering tube 160 is at the opening 142 of the production tunnel 140, the opening 142 of the tunnel may be partially sealed with a seal 144 such that the produced fluid may flow into the recovering tube 160 while preventing the produced fluid from flowing into the main wellbore 102. The recovering tube 160 may be located in the production tunnel 140 independently, or the recovering tube may be connected to the at least one sensor of the monitoring system 150 such that data of the produced fluid collected by the recovering tube including temperature, pressure and flowrate may be measured. In one or more embodiments, the recovering tube 160 comprises a valve 162 such that the flow of produced fluid into the recovering tube and the monitoring of the produced fluid may be stopped or initiated at will by activating or deactivating the valve 162. The valve 162 may be operated mechanically or electrically. In one or more embodiments, the recovering tube 160 includes a coiled tubing and a temporary tubing.

In case there are two or more production tunnels 140, a plurality of recovering tubes 160 may be separately and independently located at least partially in, or at the opening 142 of, each of a plurality of the production tunnels 140. In one or more embodiments, only one recovering tube 160 is located at least partially in, or at the opening 142 of, one of the plurality of the production tunnels 140. In one or more embodiments, one recovering tube 160 with branched ends is located at least partially in, or at the opening 142 of, the production tunnel 140, such that each branched end is introduced separately into each production tunnel.

In one or more embodiments, the seal 144 is any seal commonly used to seal a wellbore in the oil and gas industry. In one or more embodiments, the seal 144 may include, but is not limited to, a plug and a membrane, capable of preventing the fluid from flowing out of the production tunnel 140. In one or more embodiments, the seal 144 is made of, but is not limited to, cementitious materials and polymeric materials.

Figure 2B:
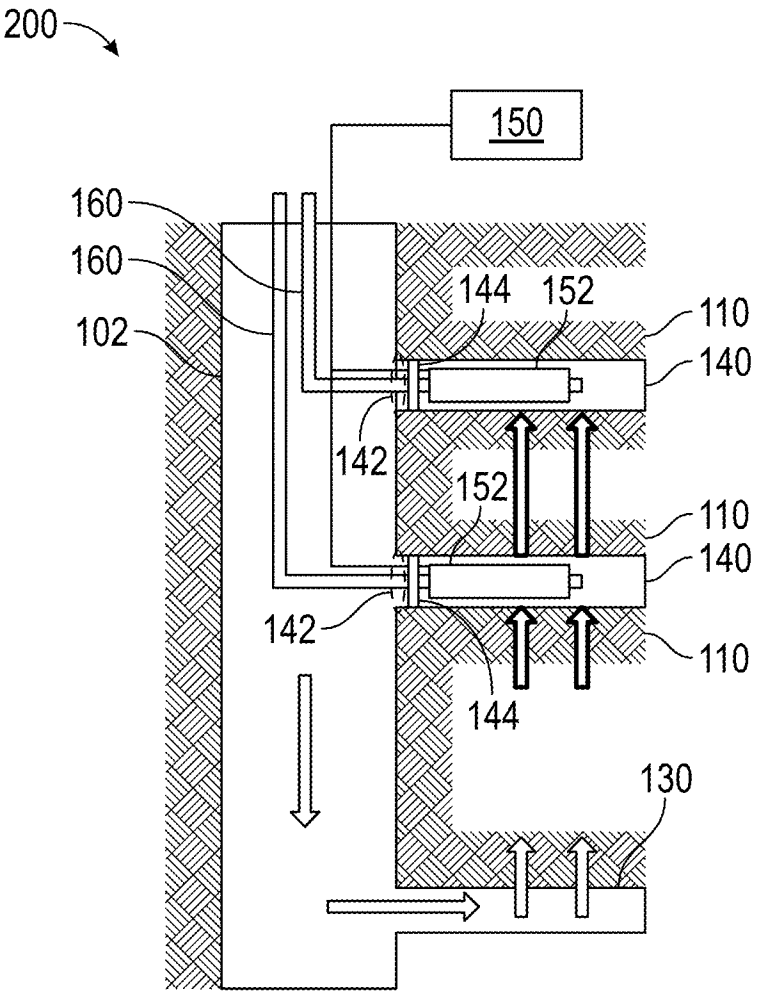
FIGS. 2A and 2B are schematic diagrams illustrating an in-situ sweep testing system with a vertical main wellbore according to one or more embodiments.
Figure 2A:
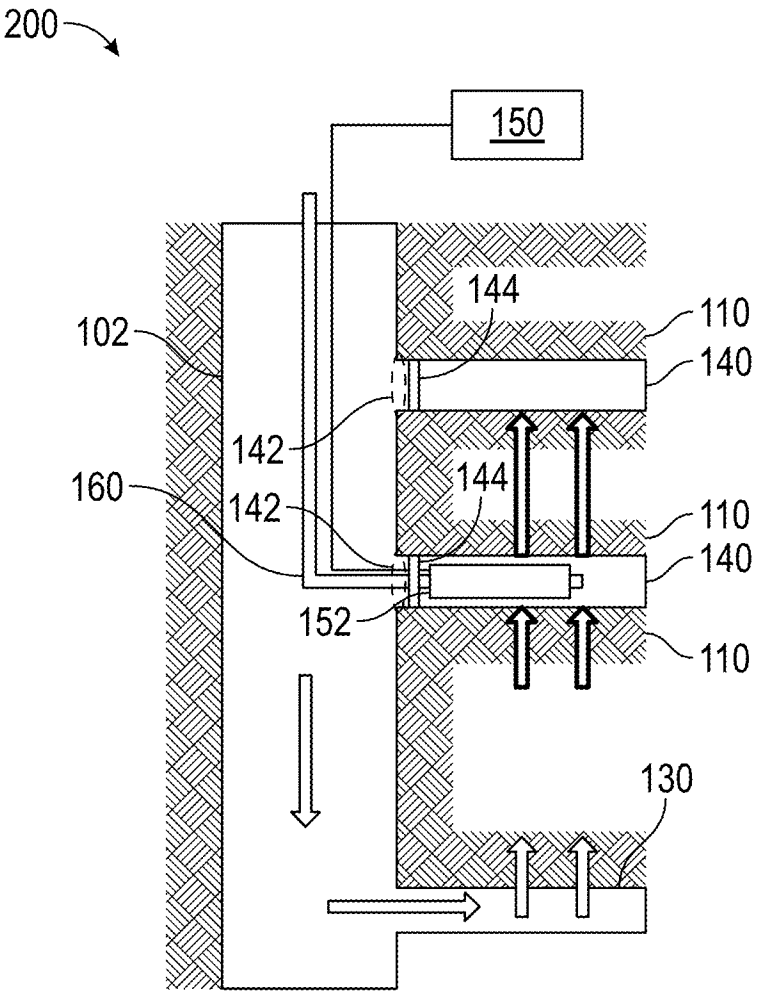

FIGS. 2A and 2B are schematic diagrams illustrating an exemplary testing system 200 with a vertical main wellbore 102 containing an injection tunnel 130 and a plurality of the production tunnels 140. At least one sensor 152 of the monitoring system 150 is connected to a recovering tube 160. The at least one sensor 152 and the recovering tube 160 is located in one of the plurality of the production tunnels 140 as shown in FIGS. 2A and 2B. Alternatively, the at least one sensor 152 may be located at the opening 142 of one of the plurality of the production tunnels 140. As shown in FIGS. 2A and 2B, the at least one sensor 152 and recovering tube 160 may be moved from one production tunnel to another production tunnel, in order to monitor the produced fluid extracted in the downstream production tunnel 140, for example. The recovering tube 160 may have branched ends with the at least one sensor 152 connected to each of the branched ends of the recovering tube 160. As shown in FIG. 2B, a plurality of sensors 152 and recovering tubes 160 may be used to monitor the conditions of the plurality of production tunnels 140. In such a case, a seal 144 is provided in the plurality of production tunnels 140 such that the fluid flows from the injection tunnel 130 to the plurality of production tunnels 140 thorough the subterranean formation 110, without recirculating back to the injection tunnel 130.

Figure 3:
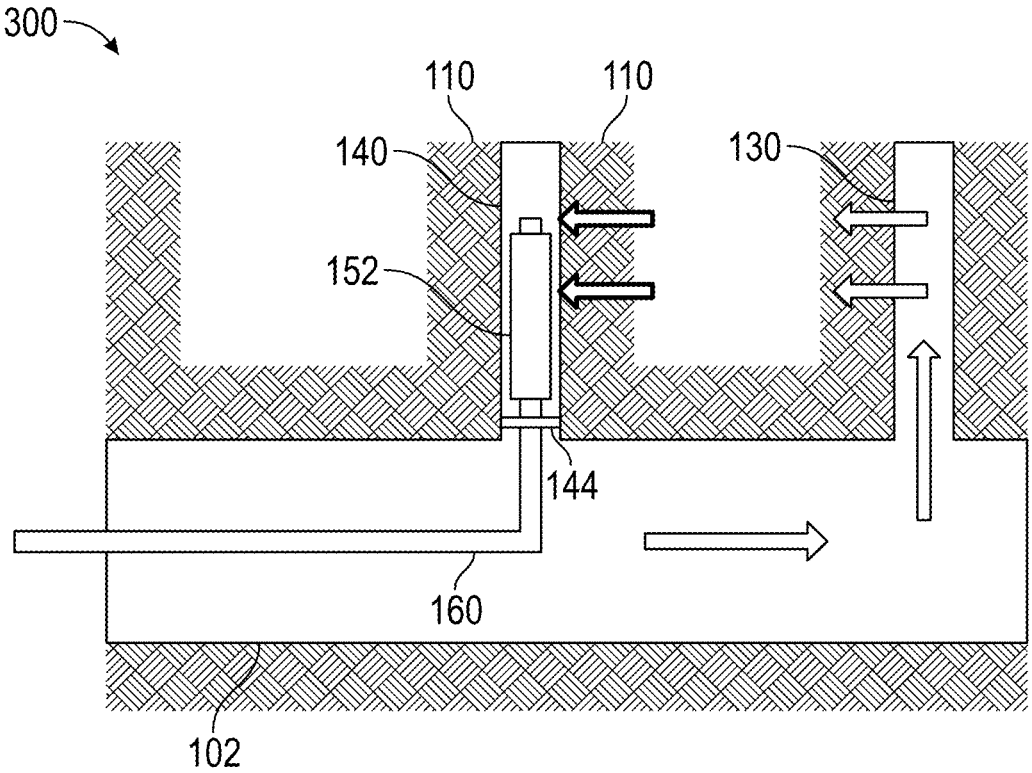
FIG. 3 is a schematic diagram illustrating an in-situ sweep testing system with a horizontal main wellbore according to one or more embodiments.
Figure 4:
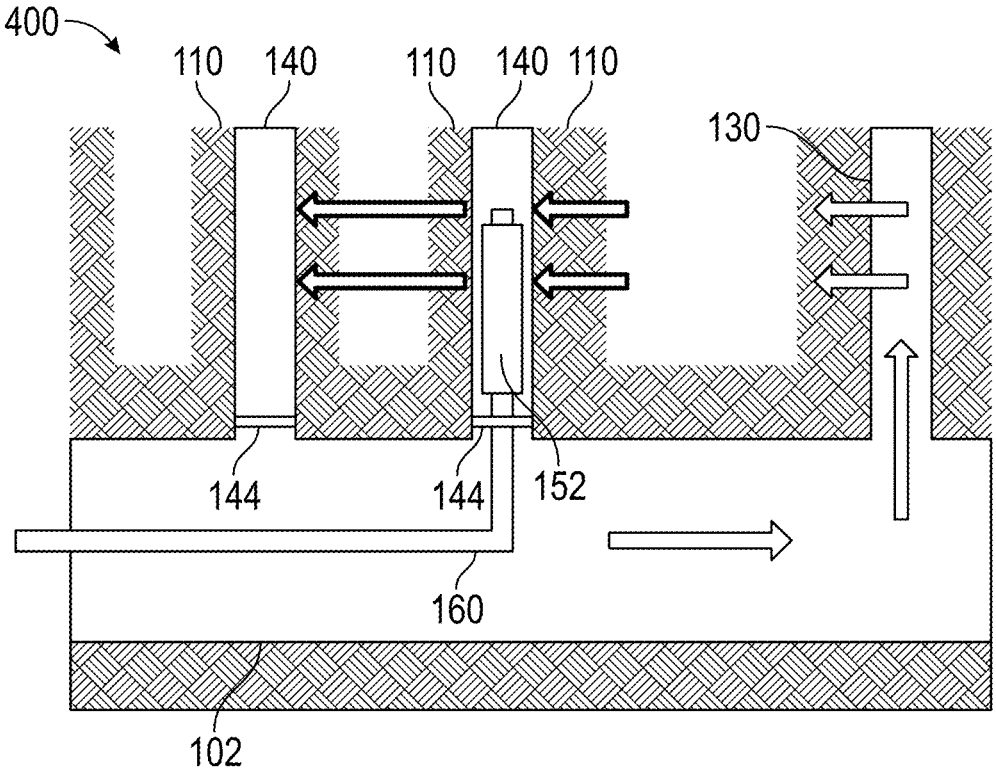
FIG. 4 is another schematic diagram illustrating an in-situ sweep testing system with a horizontal main wellbore according to one or more embodiments.

FIGS. 3 and 4 are schematic diagrams illustrating exemplary testing systems 300 and 400, respectively, in a horizontal main wellbore 102 with one production tunnel 140 and a plurality of production tunnels 140, respectively. FIGS. 3 and 4 represent top, planar views of the system. The reference numbers and corresponding elements shown in FIGS. 1, 2A and 2B apply to FIGS. 3 and 4. Although not shown in FIGS. 3 and 4, a monitoring system 150, which may include a processor and a display device, may be located outside of the main wellbore 102 above the surface, and the at least one sensor 152 may be connected to the processor and the display device with a cable, or the at least one sensor 152 may communicate with the processor wirelessly. The sweep testing in a horizonal wellbore configuration may be conducted in the same manner as described for the vertical wellbore.

Method for Conducting In-Situ Sweep Testing

In another aspect, embodiments disclosed herein relate to a method for conducting in-situ oil recovery sweep testing. The method may include conducting a sweeping process. The sweeping process may include introducing an injection fluid into the main wellbore 102 and the at least one injection tunnel 130 to extract a produced fluid in at least one production tunnel 140, monitoring conditions of the at least one production tunnel with a monitoring system 150, and collecting the produced fluid in the at least one production tunnel 140 with a recovering tube 160. The at least one injection tunnel 130 and the at least one production tunnel 140 may extend in a perpendicular direction to a length direction of the main wellbore 102. The monitoring system 150 may comprise at least one sensor 152, and the monitoring system 150 and the recovering tube 160 may be located in the at least one production tunnel 140. The method may allow properties and behavior of displacement fluids close to those in the actual oil recovery operation to be obtained with less operation and logistical costs compared to a full-scale field operation.

Figure 5:
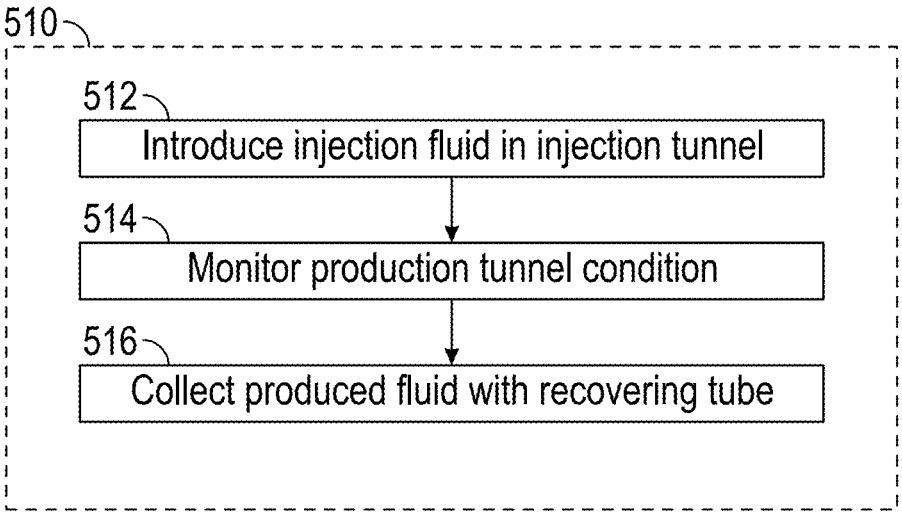
FIG. 5 is a flow chart representing a method for conducting in-situ oil recovery sweep testing according to one or more embodiments.

FIG. 5 is a flow chart representing an exemplary method for conducting in-situ oil recovery sweep testing according to one or more embodiments. The method may be conducted in a testing system as depicted in FIGS. 1-4.

A sweeping process 510 includes introducing an injection fluid into a main wellbore 102 and at least one injection tunnel 130 to extract a produced fluid in at least one production tunnel 140 (shown as step 512), monitoring conditions of the at least one production tunnel 140 with a monitoring system 150 comprising at least one sensor 152 (shown as step 514), and collecting the produced fluid in the at least one production tunnel 140 with a recovering tube 160 (shown as step 516).

At 512, the injection fluid is introduced into the main wellbore 102, and then into the injection tunnel 130, which results in the produced fluid to be extracted into the production tunnel 140. The injection fluid may be introduced continuously until sweep testing is completed, or may be introduced intermittently.

At 514, conditions of the production tunnel 140 are monitored with the monitoring system 150 comprising at least one sensor 152 located in, or at the opening 142 of, the production tunnel 140. The at least one sensor 152 is located in the production tunnel 140, as shown in FIG. 1.-4 Alternatively, the at least one sensor 152 may be located at the opening 142 of the production tunnel 140. The monitored conditions may include a pressure and a temperature of the production tunnel 140, and a flow rate of the produced fluid extracted into the production tunnel 140.

At 516, the produced fluid is collected with the recovering tube 160 at least partially located in, or at the opening 142 of, the production tunnel 140 for recovery calculation and analysis. The produced fluid may flow through the recovering tube 160 and be retrieved at a location outside of the main wellbore, such as at the surface.

In one or more embodiments, the injection fluid is a suitable injection fluid used in oil and gas industry, such as injection fluid for secondary and tertiary oil recovery operation. In one or more embodiments, the injection fluid is an aqueous fluid containing water, or an enhanced oil recovery (EOR) fluid. In one or more embodiments, the EOR fluid is a caustic or acidic solution, and contains at least one of surfactants, polymers, solvents, or combinations thereof.

In one or more embodiments, the sweeping process includes monitoring conditions of the at least one production tunnel 140 with the monitoring system 150. Parameters such as temperature and pressure of the production tunnel 140 and the flowrate of the produced fluid extracted into the production tunnel 140 may be monitored.

In one or more embodiments, the method also includes collecting the produced fluid in the production tunnel 140 with the recovering tube 160. The recovering tube 160 may be connected to any of the monitoring system 150, other equipment, and at least one sensors, and may be used to obtain data such as pressure, temperature of the production tunnel and the flow rate of the produced fluid collected by the recovering tube 160. The collected sample and data may be used to evaluate the injectivity of the subterranean formation, or the ability of the formation to receive injection fluid, analyze the produced fluid, and obtain other necessary information associated with the enhanced oil recovery operation.

In cases where there is a plurality of production tunnels 140, such as at least two production tunnels, the sweeping process may be conducted such that a plurality of recovering tubes 160 may be separately and independently introduced into each of a plurality of the production tunnels 140. The monitoring conditions of the at least one production tunnel, and collecting produced fluid may be conducted simultaneously or separately in each production tunnel.

In one or more embodiments, the sweeping process 510 is conducted in each production tunnel 140 sequentially in order to assess the oil bank progress. In such a case, the method for conducting sequential in-situ oil recovery sweep testing may include at least partially locating a recovering tube in, or at the opening 142 of, a target production tunnel of the at least two production tunnels, conducting a sweeping process, then repeating the locating of the recovering tube and conducting the sweeping process.

The sweeping process 510 may include introducing an injection fluid into the main wellbore and the at least one injection tunnel to extract a produced fluid in the target production tunnel, monitoring conditions of the target production tunnel with a monitoring system comprising at least one sensor located in, or at the opening of, the target production tunnel, and collecting the produced fluid from the target production tunnel with the recovering tube at least partially located in, or at the opening of, the target production tunnel. The sweeping process may further include isolating the target production tunnel to be an isolated production tunnel.

In one or more embodiments, the method further comprises sealing at least one of the production tunnels 140 prior to conducting the sweeping process 510, which includes the introducing, monitoring and collecting steps. The production tunnel 140 may be sealed with a seal 144 (as shown in FIG. 1, for example). Sealing of a production tunnel 140 refers to as creating a blockage at or near the opening 142 of the production tunnel 140 such that the produced fluid inside of the production tunnel 140 does not flow out of the production tunnel 140 through the opening 142 into the main wellbore 102. A sealed production tunnel 140 allows the produced fluid to either flow into a recovering tube 160 or into a subterranean formation 110.

Figure 6:
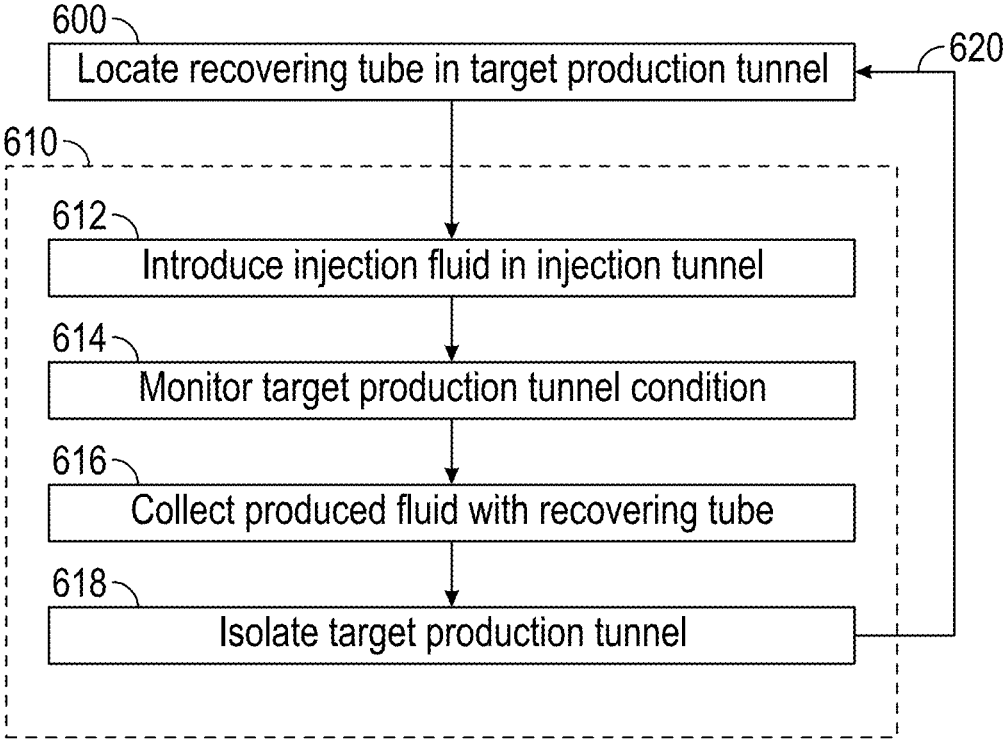
FIG. 6 is a flow chart representing a method for conducting in-situ oil recovery sweep testing according to one or more embodiments.

FIG. 6 is a flow chart representing an exemplary method for conducing in-situ oil recovery sweep testing which includes at least two production tunnels and in which the sweeping process is conducted sequentially in each production tunnel. The method may be conducted in a testing system as depicted in FIGS. 1-4 and 7A-B.

Figure 7B:
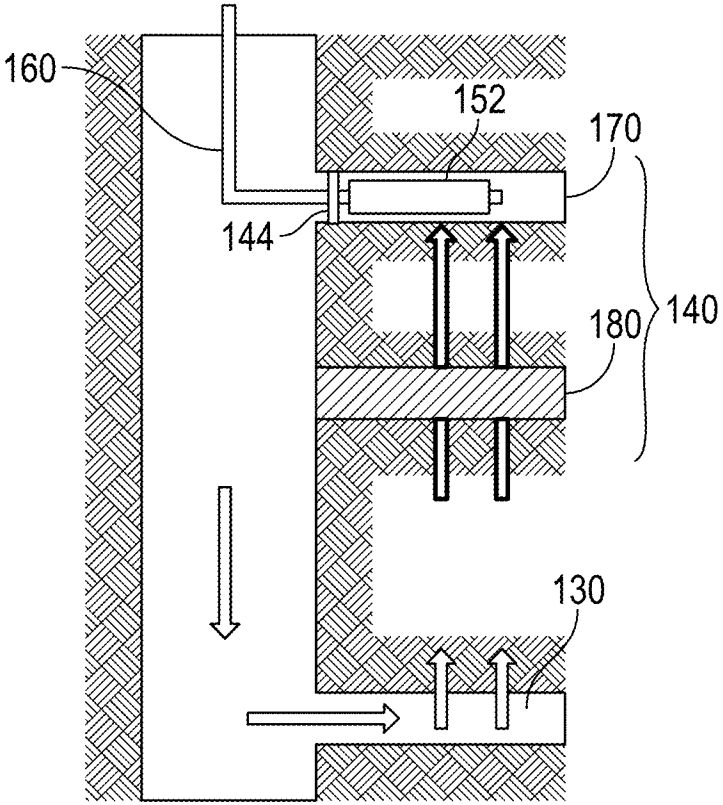
FIG. 7B is another schematic diagram illustrating a method for conducting in-situ oil recovery sweep testing in a vertical main wellbore according to one or more embodiments.
Figure 7A:
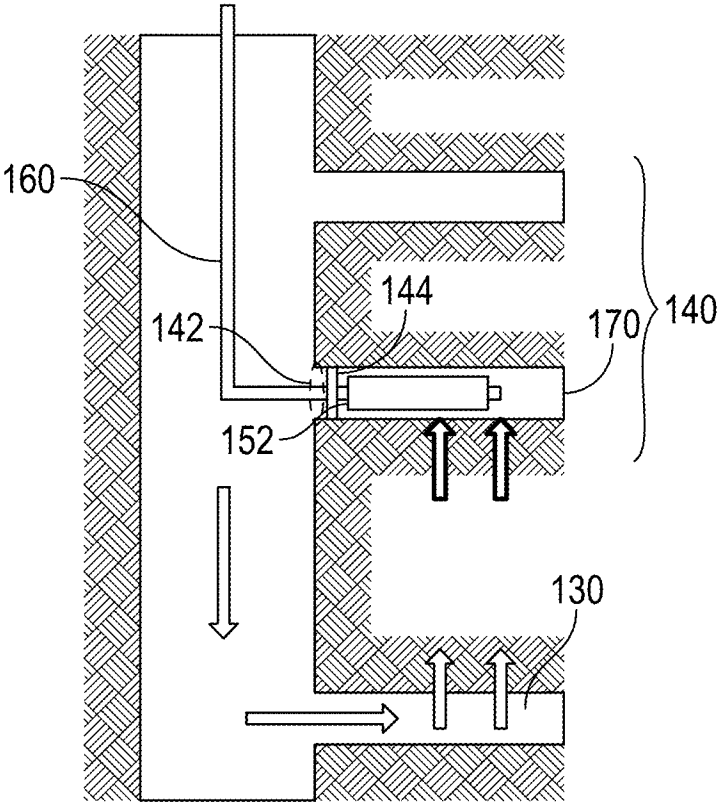
FIG. 7A is a schematic diagram illustrating a method for conducting in-situ oil recovery sweep testing in a vertical main wellbore according to one or more embodiments.

At 600, a recovering tube 160 is at least partially located in a target production tunnel 170 of the at least two production tunnels 140, as shown in FIG. 7A. Alternatively, the recovering tube 160 may be located at the opening 142 of the target production tunnel 170. The recovering tube 160 is at least partially located in the target production tunnel 170 and connected to the at least one sensor 152 as shown in FIG. 7A, or may be located in the target production tunnel 170 independently and separately from the at least one sensor 152 (not shown).

A target production tunnel refers to a production tunnel in which the sweeping process is being conducted. The target production tunnel may be a most upstream production tunnel, or a production tunnel closest to, the injection tunnel 130, excluding an isolated production tunnel 180, as shown in FIG. 7B. An isolated production tunnel 180 is a production tunnel 140 which has been modified such that the produced fluid from the formation cannot flow into the isolated production tunnel 180 to be extracted. The produced fluid may pass by the isolated production tunnel 180, and may be extracted via the target production tunnel 170. A method of isolating a production tunnel is described in the subsequent section.

A sweeping process 610 includes introducing an injection fluid into the main wellbore 102 and the at least one injection tunnel 130 to extract a produced fluid in the target production tunnel 170 (shown as step 612), monitoring conditions of the target production tunnel 170 with a monitoring system 150 comprising at least one sensor 152 located in the target production tunnel 170 (shown as step 614), and collecting the produced fluid from the target production tunnel 170 with the recovering tube 160 at least partially located in the target production tunnel 170 (shown as step 616). Alternatively, the sensor 152 may be located at the opening 142 of the target production tunnel 170. The sweeping process 610 also includes isolating the target production tunnel 170 to be an isolated production tunnel 180 (shown as step 618).

At 612, an injection fluid is introduced into the main wellbore 102, and then into the injection tunnel 130. The injection fluid enters the subterranean formation 110 and displaces the formation fluid. The displaced formation fluid is extracted via the target production tunnel 170 as a produced fluid, as shown in FIG. 7A.

At 614, conditions of the target production tunnel 170 are monitored with the monitoring system 150 comprising at least one sensor 152. The monitored conditions may include a pressure and a temperature of the target production tunnel 170, and a flow rate of the produced fluid extracted into the target production tunnel 170. A plurality of sensors 152 may be located in each of the plurality of the production tunnels 140, as shown in FIG. 7A.

At 616, the produced fluid is collected in the target production tunnel 170 with the recovering tube 160 for recovery calculation and analysis. As previously noted, the produced fluid may flow through the recovering tube 160 and retrieved at a location outside of the main wellbore 102, such as at the surface.

At 618, the target production tunnel 170 is isolated to be an isolated production tunnel 180 upon completion of the monitoring step 614 and collection step 616. A production tunnel 140 closest to the injection tunnel 130 excluding the isolated production tunnel 180 becomes the target production tunnel 170. Produced fluid is not extracted in the isolated production tunnel 180 and the fluid in the subterranean formation 110 displaced by the injection fluid passes by the isolated production tunnel 180 and is extracted in the target production tunnel 170.

At 620, locating of recovering tube 160 in the target production tunnel 170 (step 600) and conducting of the sweeping process (step 610) may be repeated as necessary until the analysis of all production tunnels 140 or a portion of the production tunnels 140 is complete. In the repeating step, the introduction of injection fluid causes the produced fluid to be extracted via the target production tunnel 170 that is different from the production tunnel where the produced fluid was extracted prior to the repeating step.

The above process provides sequential displacement of hydrocarbon between the injection tunnel 130 and a target production tunnel 170 without engaging the other production tunnels. After a target production tunnel 170 is isolated to be a production tunnel 180, and the recovering tube 160 is relocated from the isolated production tunnel 180 to the target production tunnel 170, hydrocarbon in the area between target production tunnel 170 and isolated production tunnel 180 is assessed by allowing production of fluid from the current target production tunnel 170 only. The process can be repeated in case multiple production tunnels are present.

In one or more embodiments, the isolating of the target production tunnel is conducted with a suitable technique and equipment available in the art. In one or more embodiments, the isolating is conducted by injecting a chemical which may temporarily or permanently seal the production tunnel 140 after completing the testing of the production tunnel 140 in question. In one or more embodiments, the isolating is conducted mechanically and/or electrically. For example, the recovering tube 160 may comprise a valve 162, and the valve 162 may be activated when measurement is required in the production tunnel in question. The production tunnel 140 may be isolated by deactivating the valve 162 when the measurement is no longer required. The valve 162 may be operated electronically or mechanically. In one or more embodiments, the isolating is conducted by sealing the target production tunnel 170 with a seal 144 at the opening 142 or near the opening 142 of the target production tunnel 170. In one or more embodiments, the isolating may be conducted by a combination of any of the above methods.

In one or more embodiments, the method further comprises sealing at least one of the target production tunnel 170 and the production tunnel 140 prior to the sweeping process (shown as 610 in FIG. 6). The sealing process may be repeated after the previous target production tunnel 170 is isolated and the recovering tube 160 is located in the following target production tunnel 170.

In one or more embodiments, the sweeping process is repeated until the sweeping process is conducted in every production tunnel. In one or more embodiments, the sweeping process is repeated until the sweeping process is conducted in at least two of the at least two production tunnels.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. It is the express intention of the applicant not to invoke means-plus-function for any limitations of any of the claims herein, except for those in which the claim expressly uses the words 'means for' together with an associated function.

What is claimed is:

1. A method for conducting sequential in-situ oil recovery sweep testing, the method comprising:

locating a recovering tube at least partially in, or at an opening of, a target production tunnel of at least two production tunnels extending from a main wellbore in a perpendicular direction to a length direction of the main wellbore and parallel to at least one injection tunnel extending from the main wellbore in the perpendicular direction to the length direction of the main wellbore;

conducting a sweeping process comprising:

introducing an injection fluid into the main wellbore and the at least one injection tunnel to extract a produced fluid in the target production tunnel;

monitoring conditions of the target production tunnel with a monitoring system comprising at least one sensor located in, or at the opening of, the target production tunnel;

collecting the produced fluid from the target production tunnel with the recovering tube at least partially located in, or at the opening of, the target production tunnel; and isolating the target production tunnel to be an isolated production tunnel; and repeating the locating the recovering tube and the conducting the sweeping process, wherein:

the target production tunnel is a most upstream production tunnel excluding the isolated production tunnel, and the produced fluid does not flow into the isolated production tunnel.

2. The method of claim 1, wherein:

a diameter of the at least one injection tunnel is 7 inches or less, and a diameter of the at least two production tunnel is 7 inches or less.

3. The method of claim 1, wherein the injection fluid is an aqueous fluid comprising water.

4. The method of claim 1, wherein the injection fluid is an enhanced oil recovery fluid.

5. The method of claim 1, wherein the monitoring conditions includes monitoring at least one of temperature and pressure of the at least one production tunnel, and a flowrate of the produced fluid extracted in the at least one production tunnel.

6. The method of claim 1, wherein the at least one sensor is connected to the recovering tube or located in the recovering tube.

7. The method of claim 1, wherein the at least one sensor is located in the recovering tube.

8. The method of claim 1, wherein the isolating is conducted by injecting a chemical to seal the target production tunnel.

9. The method of claim 1, wherein;

the recovering tube comprises a valve, and the isolating is conducted by deactivating the valve.

10. The method of claim 1, wherein the isolating is conducted upon completion of the monitoring and the collecting.

11. The method of claim 1, wherein no production fluid is extracted from the isolated production tunnel.

12. The method of claim 1, further comprising sealing the target production tunnel prior to the conducting the sweeping process.

* * * * *